US006234143B1

(12) United States Patent
Bartel et al.

(10) Patent No.: US 6,234,143 B1
(45) Date of Patent: May 22, 2001

(54) ENGINE EXHAUST BRAKE HAVING A SINGLE VALVE ACTUATION

(75) Inventors: John B. Bartel, Hedgesville, WV (US); Joseph H. Schmidt, Hagerstown; Jeffrey S. Zsoldos, Mount Airy, both of MD (US)

(73) Assignee: Mack Trucks, Inc., Allentown, PA (US)

( * ) Notice: Subject to any disclaimer, the term of this patent is extended or adjusted under 35 U.S.C. 154(b) by 0 days.

(21) Appl. No.: 09/356,467

(22) Filed: Jul. 19, 1999

(51) Int. Cl.[7] ..... F02D 13/04
(52) U.S. Cl. ..... 123/321
(58) Field of Search ..... 123/321, 322

(56) References Cited

U.S. PATENT DOCUMENTS

| | | | |
|---|---|---|---|
| 2,002,196 | 5/1935 | Ucko | 123/321 |
| 2,178,152 | 10/1939 | Walker | 123/321 |
| 2,264,914 | 12/1941 | L'Orange | 239/132.5 |
| 2,886,014 | 5/1959 | Konrad et al. | 239/132 |
| 3,023,870 | 3/1962 | Udelman | 477/188 |
| 3,220,392 | 11/1965 | Cummins | 123/321 |
| 3,332,405 | 7/1967 | Haviland | 123/321 |
| 3,367,312 | 2/1968 | Jonsson | 123/321 |
| 3,786,792 | 1/1974 | Pelizzoni et al. | 123/321 |
| 3,809,033 | 5/1974 | Cartledge | 123/90.46 |
| 4,399,787 | 8/1983 | Cavanagh | 123/321 |
| 4,471,909 | 9/1984 | Perr | 239/89 |
| 4,473,047 | 9/1984 | Jakuba et al. | 123/323 |
| 4,572,114 | 2/1986 | Sickler | 123/21 |
| 4,592,319 | 6/1986 | Meistrick | 123/321 |
| 4,658,781 | 4/1987 | Guinea | 123/325 |
| 4,706,625 | 11/1987 | Meistrick et al. | 123/321 |
| 4,711,210 | 12/1987 | Reichenbach | 123/321 |
| 4,741,307 | 5/1988 | Meneely | 123/321 |
| 4,793,307 | 12/1988 | Quenneville et al. | 123/323 |
| 4,848,289 | 7/1989 | Meneely | 123/182.1 |
| 4,932,372 | 6/1990 | Meneely | 123/182.1 |
| 4,944,256 | 7/1990 | Matayoshi et al. | 123/90.24 |
| 4,945,870 | 8/1990 | Richeson | 123/90.11 |
| 5,012,778 | 5/1991 | Pitzi | 123/321 |
| 5,117,790 | 6/1992 | Clarke et al. | 123/321 |
| 5,146,890 | 9/1992 | Gobert et al. | 123/321 |
| 5,255,650 | 10/1993 | Faletti et al. | 123/322 |
| 5,507,261 | 4/1996 | Johnson, Jr. | 123/322 |
| 5,535,710 | 7/1996 | Zoschke et al. | 123/90.23 |
| 5,537,976 | 7/1996 | Hu | 123/322 |
| 5,564,385 | 10/1996 | Hakansson | 123/321 |
| 5,603,300 | 2/1997 | Feucht et al. | 123/322 |
| 5,615,653 | 4/1997 | Faletti et al. | 123/322 |
| 5,622,146 | 4/1997 | Speil | 123/90.22 |
| 5,626,116 | 5/1997 | Reedy et al. | 123/321 |
| 5,634,447 | 6/1997 | Rowells | 123/322 |
| 5,655,488 | 8/1997 | Hampton et al. | 123/90.16 |
| 5,680,841 | 10/1997 | Hu | 123/322 |
| 5,730,102 | 3/1998 | Arnold et al. | 123/322 |
| 5,758,620 | 6/1998 | Warner | 123/321 |
| 5,813,231 | 9/1998 | Faletti et al. | 60/602 |
| 5,996,550 * | 12/1999 | Israel et al. | 123/322 |

* cited by examiner

*Primary Examiner*—Andrew M. Dolinar
(74) *Attorney, Agent, or Firm*—Rothwell, Figg, Ernst & Manbeck

(57) ABSTRACT

An engine exhaust braking method and apparatus is provided according to the invention. The engine exhaust braking method includes the steps of actuating an exhaust valve during an intake stroke of the engine, holding the exhaust valve open during a first portion of a compression stroke of the engine, and closing the exhaust valve when a corresponding piston of the engine is more than one-half way through a compression stroke, wherein a cylinder corresponding to the exhaust valve is precharged by higher pressure air from the exhaust manifold.

14 Claims, 10 Drawing Sheets

ENGINE EXHAUST BRAKE HAVING A SINGLE VALVE ACTUATION

BACKGROUND OF THE INVENTION

1. Field of the Invention

The present invention relates to the field of engine exhaust brake.

2. Description of the Background Art

Exhaust braking is an engine operating mode wherein the engine is reconfigured during operation to provide a braking effect to a vehicle. This may be desirable or necessary when regular wheel brakes are inadequate to provide complete braking. An example is a need for powerful and prolonged braking operations on steep grades, such as on mountain roads. Exhaust braking finds particular applicability on large vehicles having high wheel weights and correspondingly high momentum, and where conventional wheel brakes may fade or fail under high loading conditions or under prolonged use.

An engine brake works by opening exhaust valves at or near the end of the compression stroke of an associated cylinder. During the compression stroke of an engine, the air in a cylinder is compressed, requiring a work input by the engine. In normal engine operation the combustion stroke follows the compression stroke and recoups the work expended during the compression stroke. The opening of the exhaust valve near the end of the compression stroke means that no expansion of the compressed air occurs, with the air being exhausted from the engine (preferably, fuel is not injected into the engine during exhaust brake operation so that fuel is not passed through the engine unburned). The net result is that during exhaust brake operation the engine is absorbing power and not generating power. The engine exhaust brake is therefore an efficient braking system that can be used as a supplement to or a substitute for conventional wheel brakes, and may be used for repeated and extended braking operations.

Exhaust brakes may use special components, or may be realized using existing valvetrain components. Generally, exhaust braking requires components that can actuate (open) an exhaust valve independent of the normal valvetrain operation, under control of an exhaust brake system. Related art exhaust brake systems have included separate independent camshafts, rocker arms, or actuators to perform actuation of exhaust valves for exhaust braking. Related art devices have in the past actuated multiple exhaust valves in unison. This is of course the simplest operation conceptually, but simultaneous opening of both exhaust valves of a cylinder during exhaust braking has drawbacks.

A first drawback of the related art is the limitation imposed on an exhaust braking system due to excessive loads on valvetrain components. Because related art exhaust brakes typically rely upon a camshaft or camshaft pushrod to pivot an associated rocker arm as part of the exhaust brake valve operation, the pushrod must do the work of actuating the exhaust valves. The maximum exhaust braking performance is therefore limited by the load-handling ability of the pushrod or valvetrain components. This load is imposed upon the valvetrain by the pressure in each cylinder. The rocker arm (and any associated exhaust brake actuator) is acted upon by the pushrod in the related art and must open both exhaust valves at the same time, while being counteracted by a high cylinder pressure. If a valve bridge is positioned across the exhaust valves and used to actuate the exhaust valves, the force required to open multiple valves is higher than the force required to open a single valve, imposing an even greater load upon the rocker arm and the pushrod. Exhaust braking performance has therefore in the past been limited to minimize problems such as, for example, wear, deformation, or breakage of pushrods, rocker arms, exhaust valve bridges, etc. If the pushrods cannot take the load, the exhaust valves may need to be opened earlier from top dead center (TDC) of a piston, thereby preventing exhaust braking from being as effective as it could optimally be.

Another drawback of related art combination exhaust brake systems which incorporate an exhaust restricter is the efficiency in which a cylinder may be charged with air for compression in exhaust braking. In combination exhaust brake operation, if the air is already somewhat compressed at the start of the compression stroke, more work must be done by the piston during the compression stroke. Precharging of a cylinder has already been done in a related art exhaust brake, U.S. Pat. No. 5,146,890 to Gobert et al. Because the air in the exhaust manifold is charged to a high pressure during the exhaust stroke of a cylinder, by opening an exhaust valve during the intake/compression stroke precharges the corresponding cylinder with high pressure air before or even during the compression stroke. Gobert discloses the opening of an exhaust valve during the latter part of an inlet stroke and during the first portion of a compression stroke. The high pressure air present in the exhaust manifold will flow into the cylinder, increasing the pressure in the cylinder. The pressure in the exhaust manifold exceeds the pressure of the intake air in the cylinder until about halfway through the compression stroke. However, Gobert discloses only a short duration opening of the exhaust valve during the compression stroke. FIG. 1 is a graph of the Gobert precharge system showing an exhaust manifold pressure 100, a cylinder pressure 102, a timing curve of the normal exhaust valve opening 105, the timing curve of the exhaust braking exhaust valve opening 108, and a timing curve of the precharge exhaust valve opening 112. As can be seen from the graph, the precharge exhaust valve opening 112 in Gobert occurs from about 170 degrees of crankshaft rotation to about 250 degrees of crankshaft rotation. It can be observed from the graph that the exhaust manifold pressure 100 exceeds the cylinder pressure 102 until about 275 to 290 degrees of crankshaft rotation, as shown by area 115 of the graph.

There remains a need in the art for improvements in engine braking systems.

SUMMARY OF THE INVENTION

What is needed therefore is a combination brake that is capable of opening a single valve of an exhaust valve pair and which is further capable of opening an exhaust valve during an extended portion of a compression stroke in order to optimally precharge the compression stroke.

An engine exhaust braking method is provided according to a first aspect of the invention. The engine exhaust braking method comprises the steps of actuating an exhaust valve during an intake stroke of the engine, holding the exhaust valve open during a first portion of a compression stroke of the engine, and closing the exhaust valve when a corresponding piston of the engine is more than one-half way through a compression stroke, wherein a cylinder corresponding to the exhaust valve is precharged by higher pressure air from the exhaust manifold.

An engine exhaust brake having a single valve actuation for an engine having a plurality of exhaust valves per cylinder is provided according to a second aspect of the invention. The engine exhaust brake comprises a rocker arm having a camshaft force receiving portion on a proximal end of the rocker arm for receiving a force applied by a camshaft, a valve actuation contact portion on a distal end of the rocker arm, and having a pivot point located between the proximal and distal ends, an exhaust valve pair having valve stems for use in valve actuation, the exhaust valve pair including a first valve and a second valve, the first valve being nearer to the pivot point of the rocker arm and inside the valve actuation contact portion of the rocker arm, a valve bridge extending across the valve stems, having a contact portion located between the valve stems and corresponding to and contacting the valve actuation portion of the rocker arm, the valve bridge actuating the exhaust valve pair when the valve actuation contact portion of the rocker arm exerts a force upon the valve bridge as the rocker arm pivots in operation, and an exhaust brake actuator formed between the pivot point and the distal end of the rocker arm, with the exhaust brake actuator including an actuator piston having a retracted position and an extended position, wherein the first valve of the exhaust valve pair may be opened by extension of the actuator piston of the exhaust brake actuator while the valve opening actuation portion of the rocker arm is out of contact with the central contact portion of the valve bridge.

An engine exhaust brake having a single valve actuation for an engine having a plurality of exhaust valves per cylinder is provided according to a third aspect of the invention. The engine exhaust brake comprises a rocker arm having a camshaft force receiving portion on a proximal end of the rocker arm for receiving a camshaft force applied by a camshaft, a valve actuation contact portion on a distal end of the rocker arm, and having a pivot point located between the proximal and distal ends, an exhaust valve pair having valve stems for use in valve actuation, the exhaust valve pair including a first valve and a second valve, the first valve being nearer to the pivot point of the rocker arm and inside the valve actuation contact portion of the rocker arm, a valve bridge extending across the valve stems, having a contact portion located between the valve stems and corresponding to and contacting the valve actuation portion of the rocker arm, the valve bridge actuating the exhaust valve pair when the valve actuation contact portion of the rocker arm exerts a force upon the valve bridge as the rocker arm pivots in operation, and a hydraulic lash adjuster formed between the pivot point and the distal end of the rocker arm, with the hydraulic lash adjuster including an actuator piston having a retracted position and an extended position, wherein the first valve of the exhaust valve pair may be opened by extension of the actuator piston of the hydraulic lash adjuster while the valve opening actuation portion of the rocker arm is out of contact with the valve bridge contact portion, and further that a contact of the actuator piston of the exhaust brake actuator with the first valve is maintained for about seven degrees of rocker arm pivot movement.

The above and other features and advantages of the present invention will be further understood from the following description of the preferred embodiment thereof, taken in conjunction with the accompanying drawings.

DETAILED DESCRIPTION OF THE PREFERRED EMBODIMENTS

Figure 2:
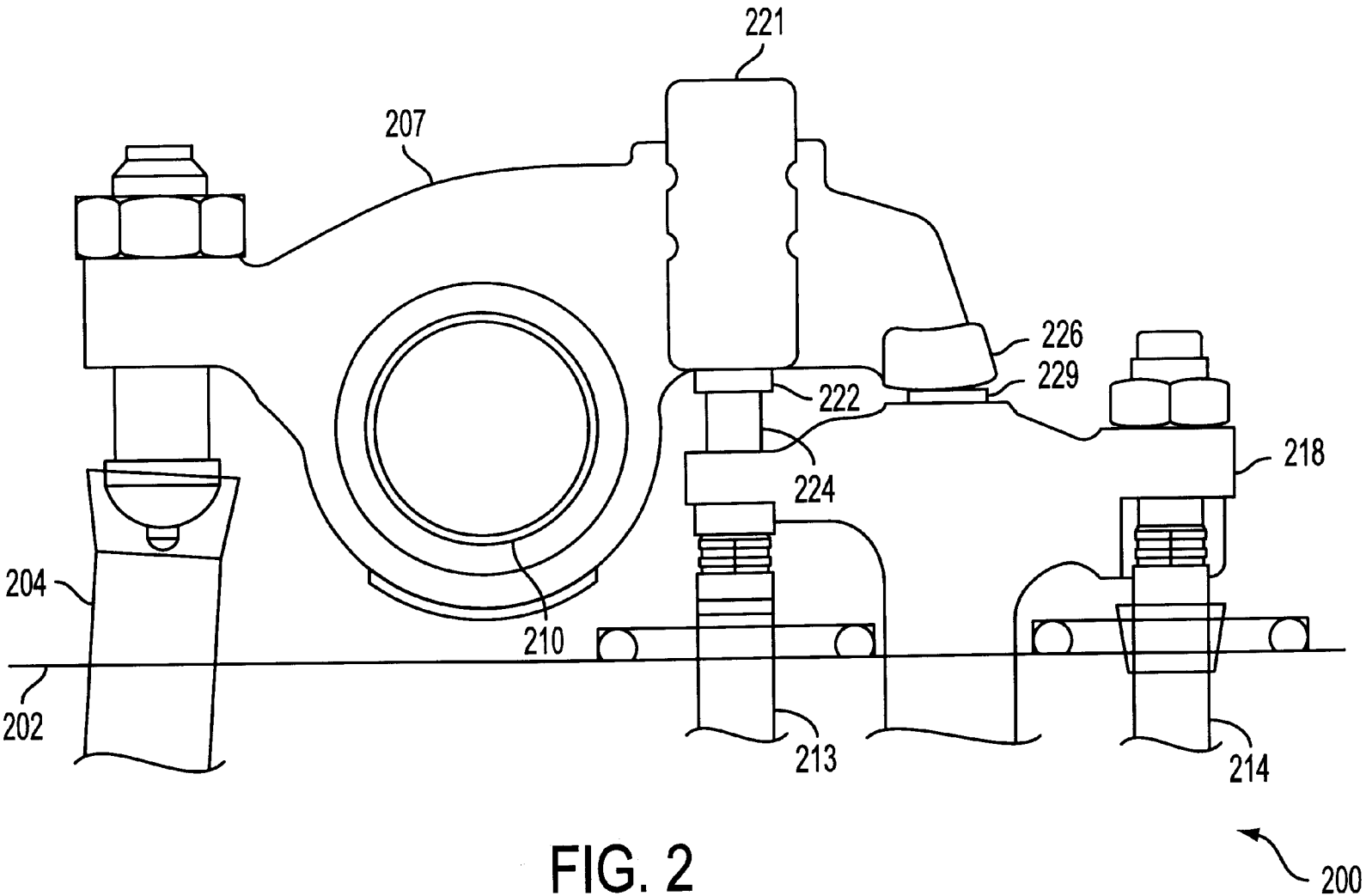
FIG. 2 shows an exhaust brake assembly of the present invention when in normal engine operation.

FIG. 2 shows an exemplary embodiment of the exhaust brake assembly 200 of the present invention. It should be understood that although the figures show an embodiment having a camshaft physically located below the rocker arm assembly, the invention as described herein applies equally well to an engine having an overhead camshaft. The illustrated embodiment of the exhaust brake assembly 200 includes a camshaft pushrod 204, a rocker arm 207 having a rocker shaft 210 about which the rocker arm 207 pivots, an exhaust valve pair including a first exhaust valve 213 and a second exhaust valve 214 and with each valve including a valve stem for actuation of the valve and with the first exhaust valve 213 further having a top portion 224, a valve bridge 218 extending across the valve stems, and an exhaust brake actuator 221 having an actuator piston 222. The rocker arm 207 further includes a camshaft pushrod receiving portion on a proximal end of the rocker arm 207, and a valve actuation contact portion 226 on a distal end. The proximal and distal ends of the rocker arm 207 are separated by the rocker shaft 210 about which the rocker arm 207 may pivot. The valve bridge further includes a central contact portion 229.

The valvetrain shown is a representative one, wherein the pushrod 204, under the influence of an associated camshaft (not shown), moves the rocker arm 207 in a rocking motion. In an overhead cam embodiment, the pushrod 204 may be left out of the valvetrain assembly. In normal exhaust stroke operation, the rocker arm 207 pivots in a clockwise direction and contacts the valve bridge 218 upon encountering an exhaust lobe of the camshaft. The contact is made between the valve actuation contact portion 226 of the rocker arm 207 and the central contact portion 229 of the valve bridge 218. Through contact with the valve bridge 218, the pushrod 204 and the rocker arm 207 exert a force against the first exhaust valve 213 and the second exhaust valve 214, causing them to open. It can be seen from the Figure that in normal operation the actuator piston 222 of the exhaust brake actuator 221 is in the retracted state. It can also be seen that the actuator piston 222 of the exhaust brake actuator 221 does not contact the top portion 224 of the first exhaust valve 213 until the valve actuation contact portion 226 of the rocker arm 207 contacts the central contact portion 229 of the valve bridge 218. Therefore, in the retracted state (i.e., in normal engine operation), the exhaust brake actuator 221 does not actuate the first exhaust valve 213.

In an alternative embodiment, the top portion 224 of the first valve 213 may be replaced by a pin 224, positioned between the valve stem of the first valve 213 and the exhaust valve actuator 221.

Figure 3:
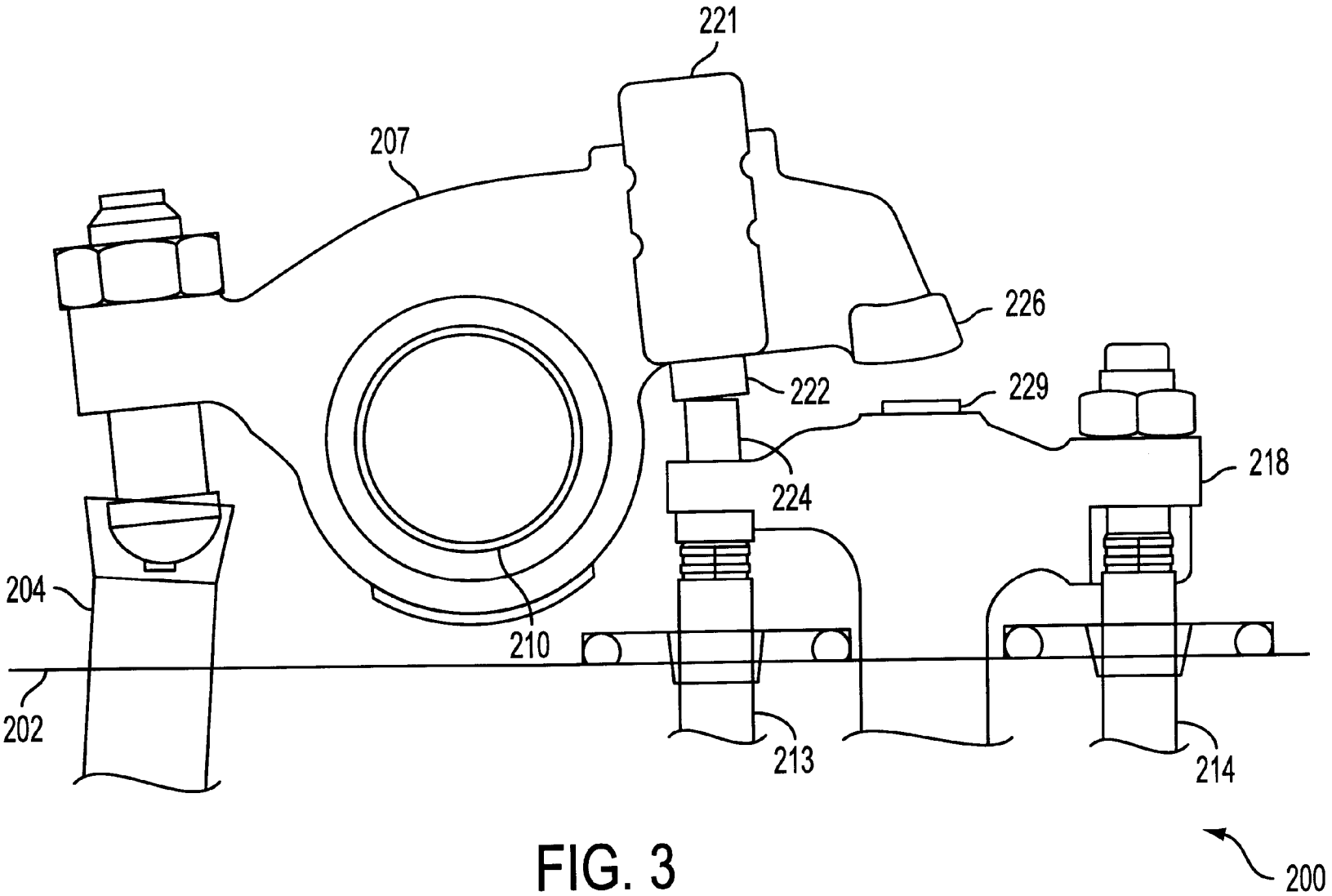
FIG. 3 shows the exhaust brake assembly of the present invention at the start of an exhaust brake cycle.

FIG. 3 shows the exhaust brake assembly 200 at the beginning of an exhaust brake actuation. In the embodiment shown, the rocker arm 207 is pivoted to a position of about four degrees counter-clockwise from horizontal. The actual position of the rocker arm 207 at first contact depends on a variety of factors, such as the shape of the rocker arm 207, camshaft profile, etc. It should be understood that the pivotal position given is merely illustrative of the embodiment shown, and that in application the pivotal position could be varied without departing from the spirit of the invention. The actuator piston 222 of the exhaust valve actuator 221 is in the actuated (extended) position. In the preferred embodiment, the actuator pistont 222 has an extended position and a retracted position. Alternatively, the actuator piston 222 may have more than two positions, or may have a continuous range of positions between the retracted position and the extended position. In the preferred embodiment, the actuator piston 222 of the exhaust brake actuator 221 is hydraulic, having a hydraulic port (not shown) communicating a hydraulic fluid to the actuator piston 222, wherein a valve may block the hydraulic fluid within the exhaust brake actuator 221 to hold the actuator piston 222 in the extended position. As can be seen from the figure, the position of the rocker arm 207 is one in which contact is first made between the extended actuator piston 222 of the exhaust brake actuator 221 and the top portion 224 of the first exhaust valve 213. As the rocker arm 207 pivots further in a clockwise direction, the first exhaust valve 213 will be opened. The pivoting of the rocker arm 207 may be accomplished by an exhaust braking bump on the camshaft, with the exhaust braking bump not being large enough to bring the valve actuation contact portion 226 of the rocker arm 207 into contact with the central contact portion 229 of the valve bridge 218. The exhaust braking bump in conjunction with the exhaust brake actuator 221 combine to actuate the first exhaust valve 213 for exhaust braking.

The opening of only the first exhaust valve 213 reduces the load imposed on the pushrod by fifty percent for any given cylinder pressure when compared to a two valve exhaust braking operation. The imposed load is even further reduced since the valve closest to the rocker shaft 210 is the valve being opened. The engine braking performance can now be optimized without being limited by cylinder pressures, and with less compliance in the valvetrain. The invention may be used either alone as a mass flow brake system or in combination with an exhaust restriction device (commonly referred to as a combination or combo brake).

Figure 4:
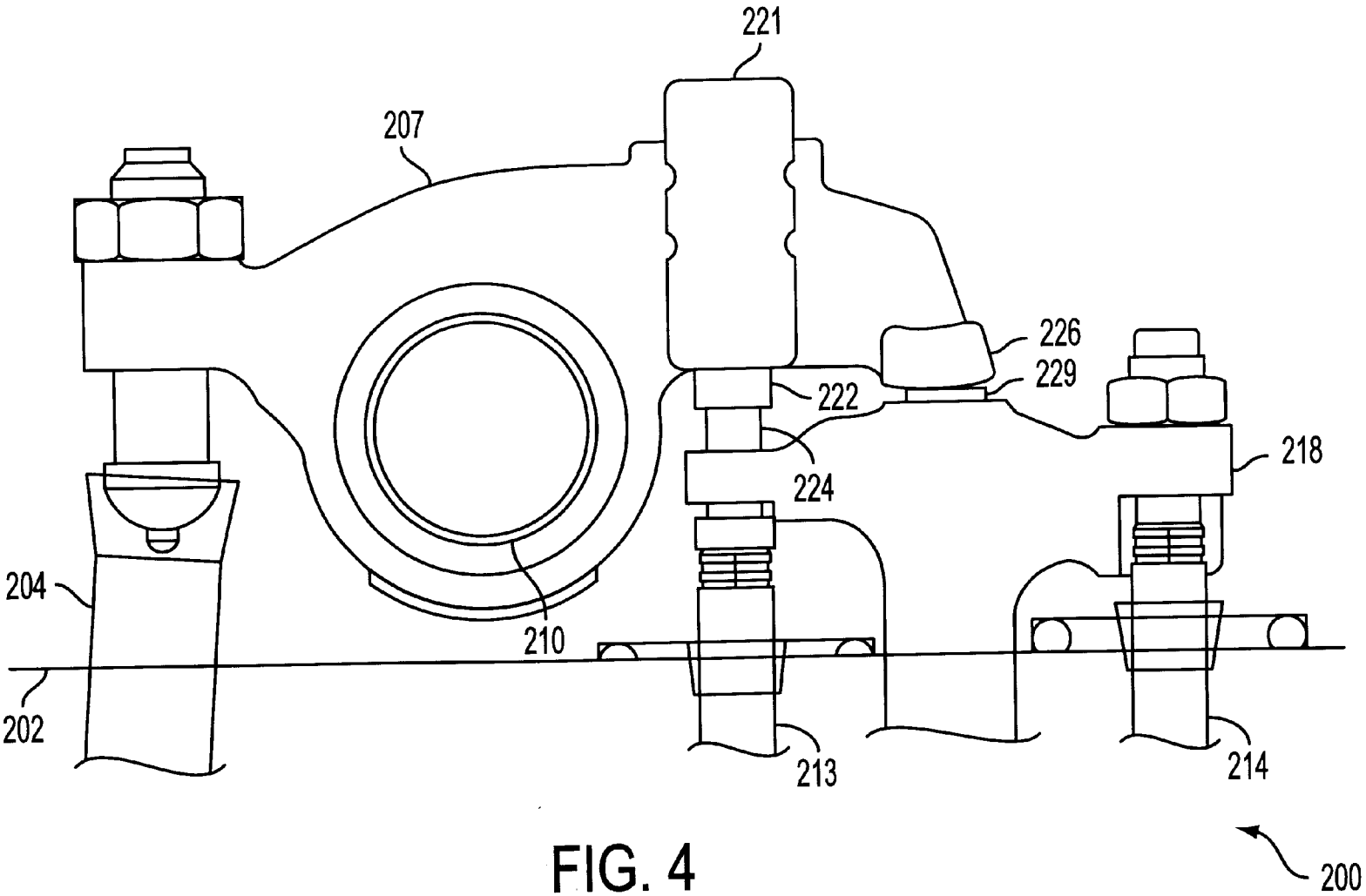
FIG. 4 shows the exhaust brake assembly of the present invention during an exhaust brake cycle.

FIG. 4 shows the exhaust brake assembly 200 after the rocker arm 207 has pivoted further in a clockwise direction. In the embodiment shown, the rocker arm 207 has pivoted to a position of about zero degrees from horizontal. The first exhaust valve 213 is now open, allowing compressed air in an associated cylinder to escape during the latter portion of the compression stroke. It is at this point that the valve actuation contact portion 226 of the rocker arm 207 may contact the central contact portion 229 of the valve bridge 218.

Figure 5:
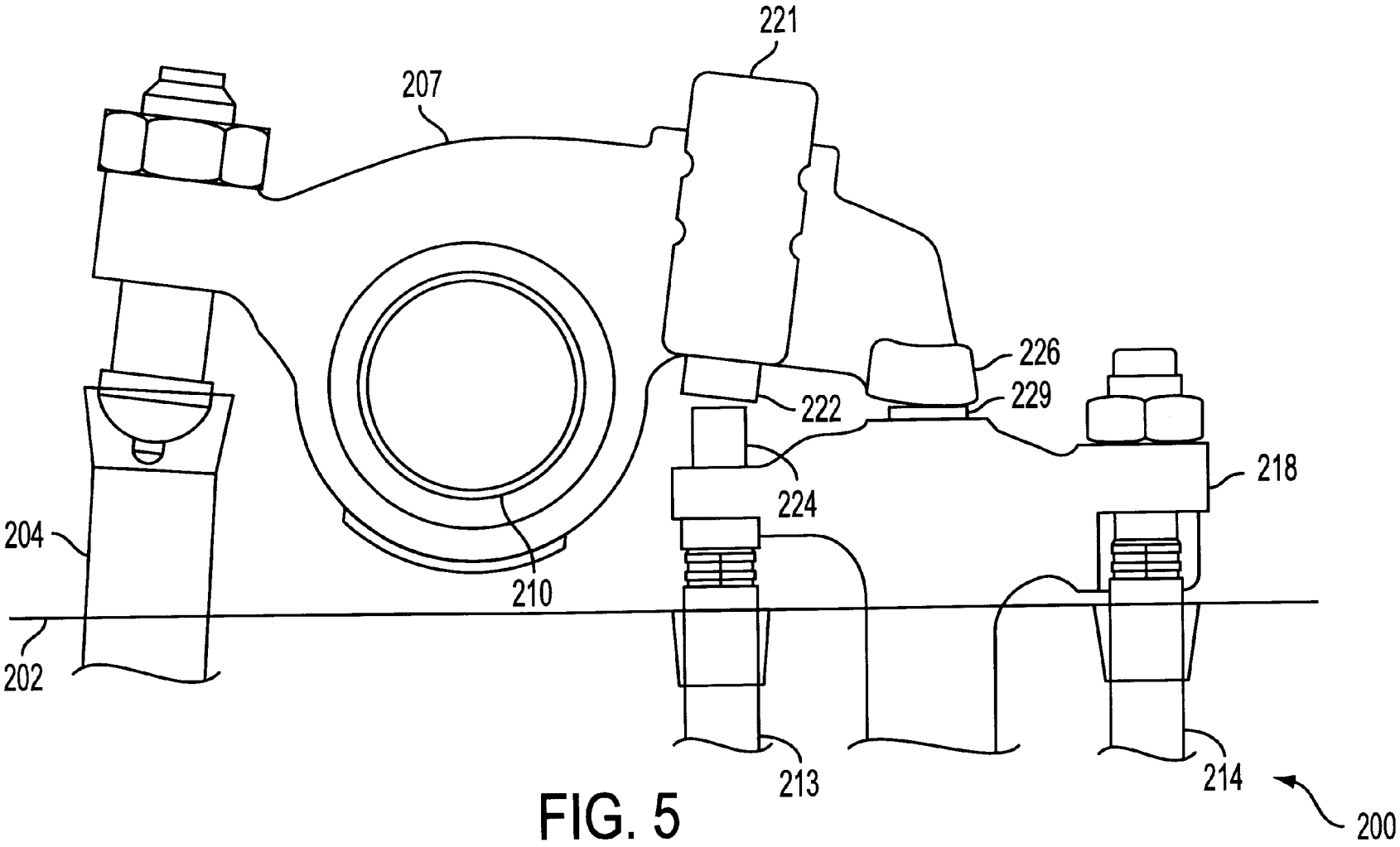
FIG. 5 shows the exhaust brake assembly of the present invention after the completion of an exhaust brake cycle.

FIG. 5 shows the exhaust brake assembly 200 after the completion of an exhaust brake cycle. In the embodiment shown, the rocker arm 207 has pivoted in a clockwise direction to a position of about seven degrees from the horizontal. It can be seen from the figure that, even with the actuator piston 222 of the exhaust brake actuator 221 extended, by the time the rocker arm 207 has pivoted to this position the actuator piston 222 has lost contact with the upper portion 224 of the first exhaust valve 213. In this manner, the normal exhaust stroke of the engine may still function even when the exhaust brake is activated. No additional valve lift is required beyond normal exhaust lift. It should be understood that at this point in the pivoting movement of the rocker arm 207 that the valve bridge 218 actuates both the first valve 213 and the second valve 214.

It should not be assumed from the proximity of FIGS. 4 and 5 that the position of the rocker arm 207 between the two figures is a progression, as the exhaust braking action may be followed by a closing of the first exhaust valve 213 for a predetermined time period before the exhaust stroke of the engine and an actuation of both the first exhaust valve 213 and the second exhaust valve 214.

Figure 1:
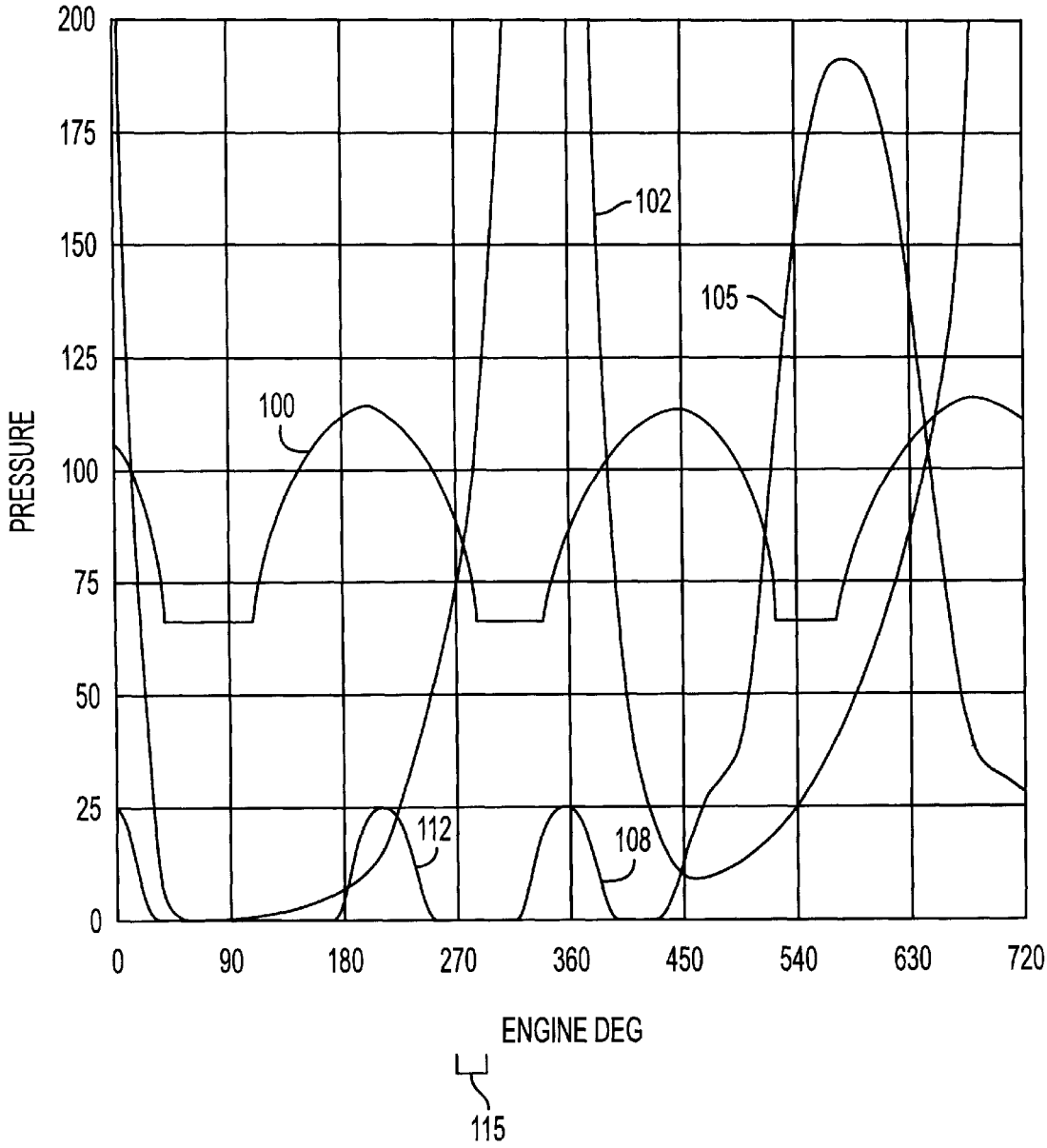
FIG. 1 (RELATED ART)
FIG. 1 shows an exhaust precharge curve of the related art.
Figure 6:
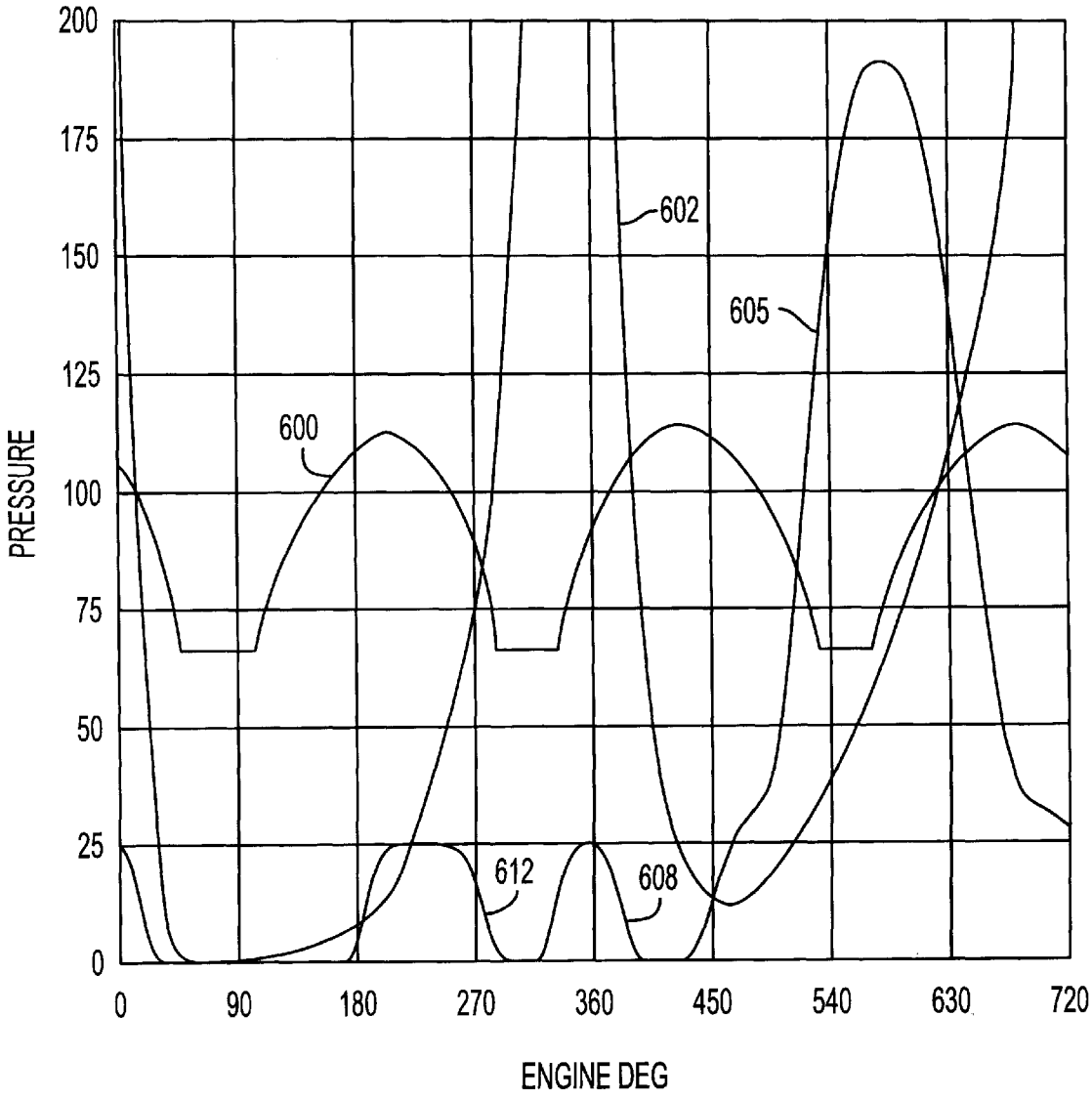
FIG. 6 shows an exhaust precharge curve of the present invention.
Figure 7:
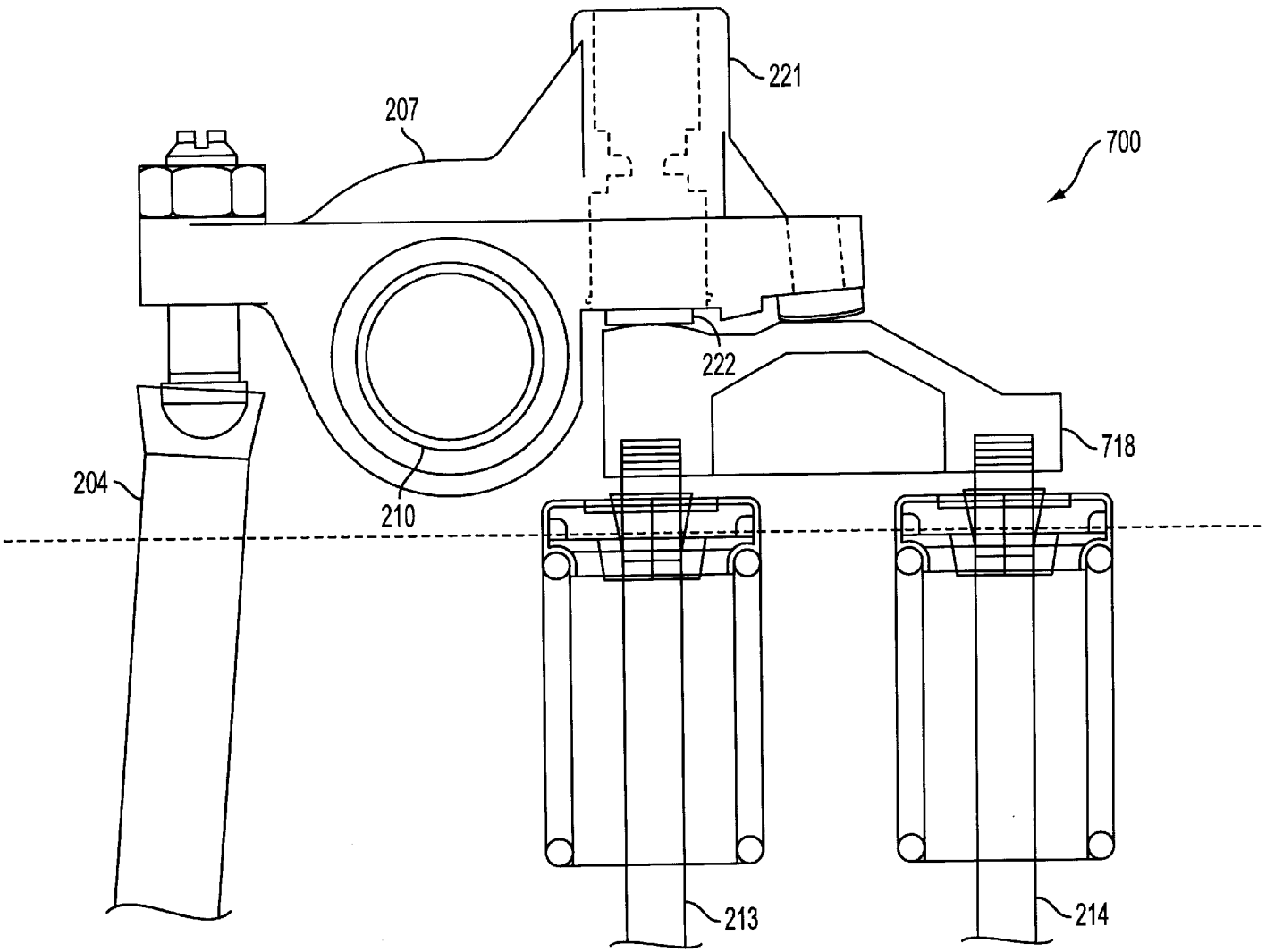
FIGS. 7–10 show the exhaust brake assembly using a pinless valve bridge, corresponding to the rocker arm movements shown in FIGS. 2–5.
Figure 8:
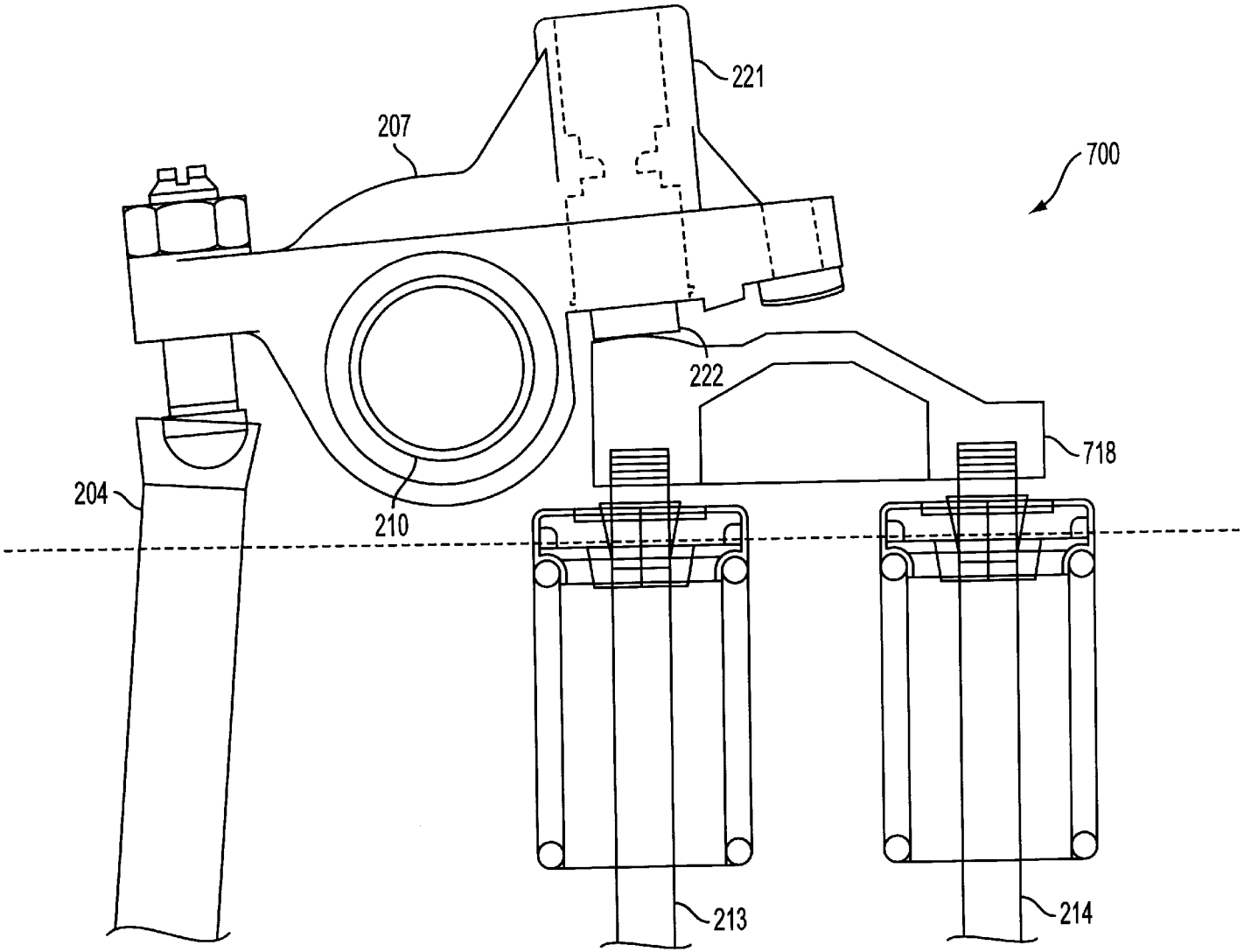
Figure 9:
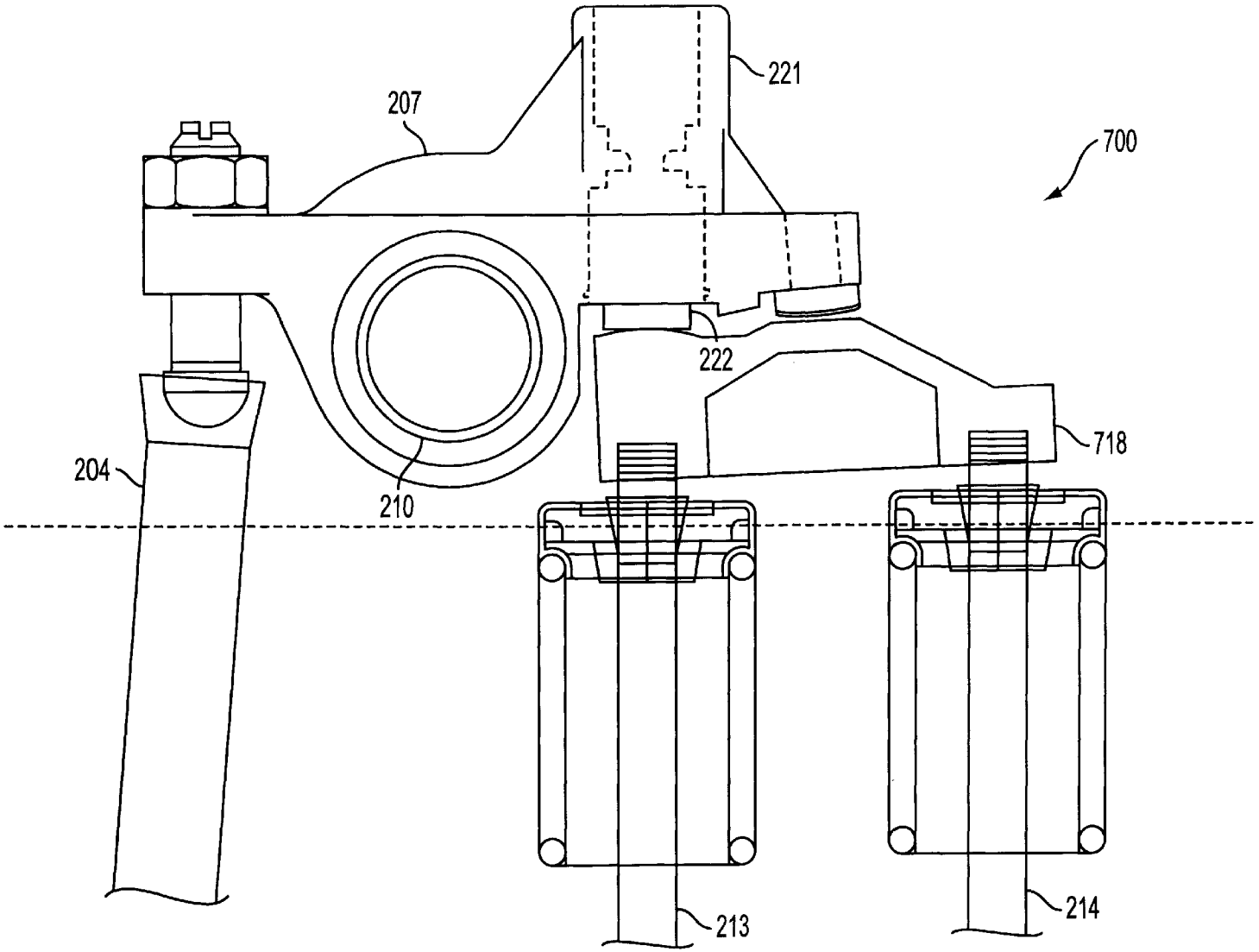
Figure 10:
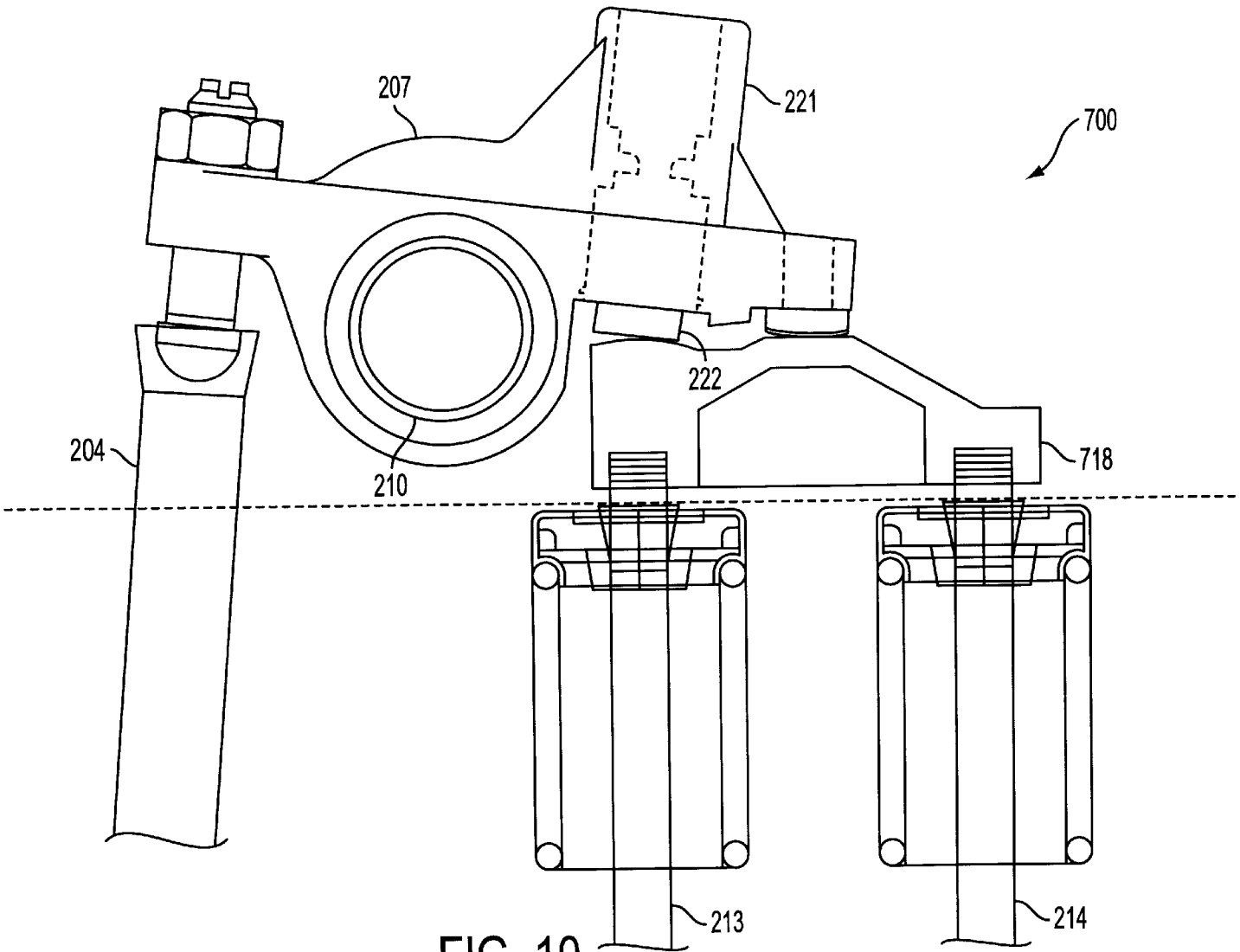

FIG. 6 shows a graph of a precharging of a cylinder as part of the exhaust brake operation of the present invention. The graph shows an exhaust manifold pressure 600, a cylinder pressure 602, a timing curve of the normal exhaust valve opening 605, a timing curve of the exhaust braking exhaust valve opening 608, and a timing curve of the precharge exhaust valve opening 612. As can be seen from the graph, the precharge exhaust valve opening 612 in the present invention stays open until after the associated piston has passed the halfway point in the compression stroke. By comparison to a precharge system of the related art (see text accompanying FIG. 1), the present invention precharges each cylinder to a higher pressure by holding an exhaust valve open until an associated piston is more than one-half way through a compression stroke. As a result of this optimal precharge, the engine in exhaust braking operation will achieve more braking power as a result of the greater power required to compress the partially pressurized precharged air.

FIGS. 7–10 show an alternate embodiment 700 of the exhaust brake assembly employing a pinless valve bridge 718. The pinless valve bridge 718 does not use a central pin to maintain alignment of the valve bridge. The embodiment 700 is shown in operation in FIGS. 7–10, corresponding to FIGS. 2–5.

While the invention has been described in detail above, the invention is not intended to be limited to the specific embodiments as described. It is evident that those skilled in the art may now make numerous uses and modifications of and departures from the specific embodiments described herein without departing from the inventive concepts. For example, the exhaust valve actuator 221 may in an alternate embodiment be able to extend the actuator piston 222 to such a length as to be able to actuate the first valve 213 irrespective of the position of the rocker arm 207.

What is claimed is:

1. An engine exhaust braking method for an engine having an exhaust manifold and a plurality of exhaust valves per cylinder, comprising the steps of:

actuating only one exhaust valve per cylinder by extending an actuator piston of an exhaust brake actuator from a rocker arm of said engine during an intake stroke of said engine; and closing said exhaust valve when a corresponding piston of said engine is more than one-half way through a compression stroke;

wherein said cylinder corresponding to said exhaust valve is precharged by higher pressure air from the exhaust manifold.

2. An engine exhaust brake having a single valve actuation for an engine having a plurality of exhaust valves per cylinder, comprising:

a rocker arm having a camshaft force receiving portion on proximal end of said rocker arm for receiving a force applied by a camshaft, a valve actuation contact portion on a distal end of said rocker arm, and having a pivot point located between said proximal and distal ends;

an exhaust valve pair having valve stems for use in valve actuation, said exhaust valve pair including a first valve and a second valve, said first valve being nearer to said pivot point of said rocker arm and inside said valve actuation contact portion of said rocker arm;

a valve bridge extending across said valve stems, having a contact portion located between said valve stems and corresponding to and contacting said valve actuation portion of said rocker arm, said valve bridge actuating said exhaust valve pair when said valve actuation contact portion of said rocker arm exerts a force upon said valve bridge as said rocker arm pivots in operation; and an exhaust brake actuator formed between said pivot point and said distal end of said rocker arm, with said exhaust brake actuator including an actuator piston having a retracted position and an extended position;

wherein said first valve of said exhaust valve pair may be opened by extension of said actuator piston of said exhaust brake actuator while said valve actuation contact portion of said rocker arm is out of contact with said central contact portion of said valve bridge.

3. The engine exhaust brake of claim 2, wherein when said actuator piston of said exhaust brake actuator is in said retracted position, said engine brake is inactive.

4. The engine exhaust brake of claim 2, wherein when said actuator piston of said exhaust brake actuator is in said extended position, said engine brake is active.

5. The engine exhaust brake of claim 2, wherein when said brake is active, said first valve opens a predetermined number of degrees of crankshaft rotation before said second valve.

6. The engine exhaust brake of claim 2, wherein a contact of exhaust brake actuator with said first valve is maintained for about seven degrees of rocker arm pivot movement.

7. The engine exhaust brake of claim 2, wherein said exhaust brake actuator is a hydraulic lash adjuster.

8. The engine exhaust brake of claim 7, wherein said actuator piston of said hydraulic lash adjuster is held in said extended position by hydraulic pressure.

9. The engine exhaust brake of claim 2, wherein said actuator piston of said exhaust brake actuator may be extended at any time in an engine cycle.

10. An engine exhaust brake having a single valve actuation for an engine having a plurality of exhaust valves per cylinder, comprising:

a rocker arm having a camshaft force receiving portion on a proximal end of said rocker arm for receiving a camshaft force applied by a camshaft and a valve actuation contact portion on a distal end of said rocker arm, and having a pivot point located between said proximal and distal ends;

an exhaust valve pair having valve stems for use in valve actuation, said exhaust valve pair including a first valve and a second valve, said first valve being nearer to said pivot point of said rocker arm and inside said valve actuation contact portion of said rocker arm;

a valve bridge extending across said valve stems, having a contact portion located between said valve stems and corresponding to and contacting said valve actuation portion of said rocker arm, said valve bridge actuating said exhaust valve pair when said valve actuation contact portion of said rocker arm exerts a force upon said valve bridge as said rocker arm pivots in operation; and a hydraulic lash adjuster formed between said pivot point and said distal end of said rocker arm, with said hydraulic lash adjuster including and actuator piston having a retracted position and an extended position;

wherein said first valve of said exhaust valve pair may be opened by extension of said actuator piston of said hydraulic lash adjuster while said valve actuation contact portion of said rocker arm is out of contact with said valve bridge contact portion, and further that a contact of said actuator piston of said hydraulic lash adjuster with said first valve is maintained for about seven degrees of rocker arm pivot movement.

11. The engine exhaust brake of claim 10, wherein when said actuator piston of said hydraulic lash adjuster is in said retracted position, said engine brake is inactive.

12. The engine exhaust brake of claim 10, wherein when said actuator piston of said hydraulic lash adjuster is in said extended position, said engine brake is active.

13. The engine exhaust brake of claim 10, wherein when brake is active, said first valve opens a predetermined number of degrees of crankshaft rotation before said second valve.

14. The engine exhaust brake of claim 10, wherein said actuator piston of said hydraulic lash adjuster may be extended at any time in an engine cycle.

* * * * *